US005819710A

United States Patent [19]

Huber

[11] Patent Number: 5,819,710

[45] Date of Patent: Oct. 13, 1998

[54] SERVO VALVE FOR AN INJECTION NOZZLE

[75] Inventor: Gerd Huber, München, Germany

[73] Assignee: Daimler Benz AG, Stuttgart, Germany

[21] Appl. No.: 735,971

[22] Filed: Oct. 25, 1996

[30] Foreign Application Priority Data

Oct. 27, 1995 [DE] Germany ..... 195 40 155.7

[51] Int. Cl.[6] ..... F02M 37/04; F02M 41/16

[52] U.S. Cl. ..... 123/498; 239/96

[58] Field of Search ..... 123/498, 467, 123/447; 239/96, 585.1

[56] References Cited

U.S. PATENT DOCUMENTS

| | | | |
|---|---|---|---|
| 4,649,886 | 3/1987 | Igashira et al. | 123/498 |
| 4,909,440 | 3/1990 | Mitsuyasu et al. | 123/467 |
| 4,993,637 | 2/1991 | Kanesaka | 239/96 |
| 4,997,133 | 3/1991 | Ausiello et al. | 239/96 |
| 5,176,120 | 1/1993 | Takahashi | 123/467 |
| 5,441,028 | 8/1995 | Felhofer | 123/456 |
| 5,551,634 | 9/1996 | Raab et al. | 239/96 |
| 5,605,134 | 2/1997 | Martin | 239/498 |

*Primary Examiner*—Thomas N. Moulis
*Attorney, Agent, or Firm*—Hodgson, Russ, Andrews, Woods & Goodyear LLP

[57] ABSTRACT

A servo valve for an injection nozzle includes a housing having a valve chamber, a high-pressure opening, a connecting opening and a return opening. The valve chamber movably accommodates a valve member which can be displaced by actuating means to bear selectively against a first seat and a second seat. The valve member, when bearing against the first seat, closes the return opening and connects the high-pressure opening to the connecting opening. When bearing against the second seat it closes the high-pressure opening and connects the connecting opening to the return opening. The connecting opening is connected to a working chamber of the injection nozzle whose nozzle is closed when the working chamber is subjected to high pressure and opens upon a drop in pressure in the working chamber. The actuating means includes a component which varies in length when electrically actuated and which is connected to the valve member through the return opening by way of an actuating member.

7 Claims, 2 Drawing Sheets

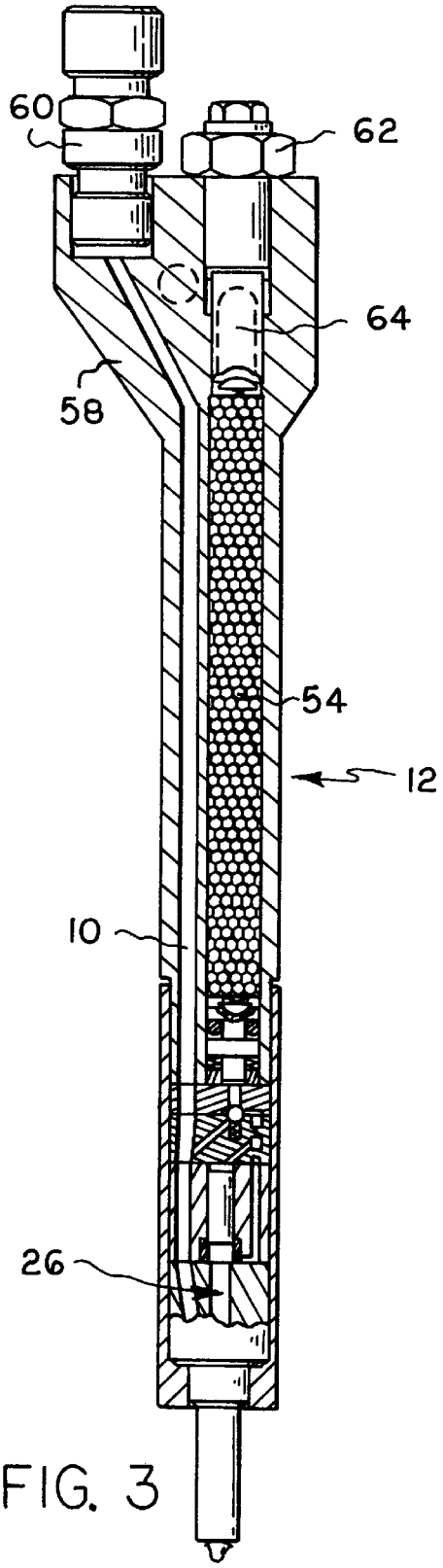
FIG. 3
FIG. 4
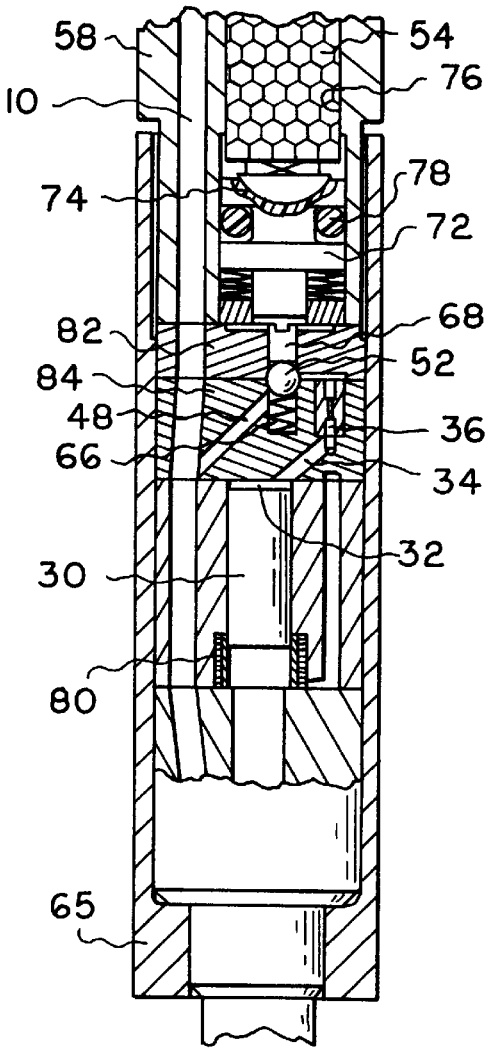
FIG. 5
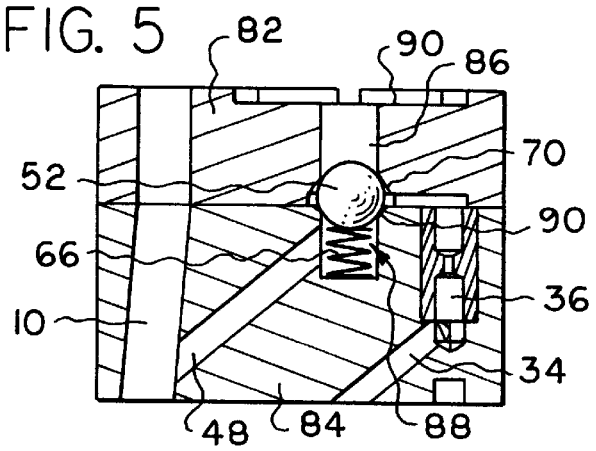

SERVO VALVE FOR AN INJECTION NOZZLE

FIELD OF THE INVENTION

The invention concerns a servo valve for an injection nozzle such as more particularly for a common-rail system.

BACKGROUND OF THE INVENTION

One form of servo valve for an injection nozzle as is disclosed in SAE paper No 910252 'Development of New Electronically Controlled Fuel Injection System ECD-U2 for Diesel Engines', includes a housing providing a valve chamber, a high-pressure opening, a connecting opening and a return opening, together with a valve member which is movable in the valve chamber and which can be caused to co-operate selectively with a first seat and a second seat by operation of an actuating means, wherein when bearing against the first seat the valve member closes the return opening and connects the high-pressure opening to the connecting opening and when bearing against the second seat the valve member closes the high-pressure opening and connects the connecting opening to the return opening. The connecting opening is adapted to be connected to a working chamber of the injection nozzle which is closed when the working pressure is put under high pressure and opens upon a drop in pressure in the working chamber. The valve member of that valve comprises an outer valve body and an inner valve body which is guided therein. The outer valve body is normally urged downwardly to bear against the first valve seat by a spring thereby to close the return opening. The inner valve body is moved upwardly by the pressure in the valve chamber and in so doing opens the high-pressure opening which is provided in the outer valve body. When an electromagnetic coil is excited the outer valve body is moved upwardly and lifts off the first seat so that the connecting opening is accordingly communicated with the return opening. The upward movement of the outer valve body continues until the second seat provided thereon moves into a condition of bearing against the inner valve body thereby closing the high-pressure opening.

That servo valve is of a comparatively complex and thus costly structure as it requires the precise production of a guide means, in its housing, for the outer valve body, and a guide means, at the inside of the outer valve body, for guiding the inner valve body. When the second seat is open, the guide means as between the inner valve body and the outer valve body is subjected to the pressure of high-pressure fluid, and that results in leakage losses. In addition electromagnetic actuation of the outer valve body, because of factors inherent in the system, involves comparatively long delay times between the commencement of excitation of the electromagnetic coil and the actual movement of the outer valve body, while in addition the movement of the outer valve body involves a comparatively large amount of friction as the outer valve body is displaced at its outside relative to the housing and at its inside relative to the inner valve body.

SUMMARY OF THE INVENTION

An object of the present invention is to provide a servo valve for an injection nozzle in which the above-indicated difficulties are substantially avoided.

Another object of the present invention is to provide a servo valve for an injection nozzle which affords a speedy actuating response and enhanced sensitivity of operation.

Still another object of the present invention is to provide a servo valve for an injection nozzle which is of a simple structure and inexpensive to produce while affording precise and accurately controllable actuating movements.

Yet another object of the present invention is to provide a servo valve for an injection nozzle which is so designed as to afford an improved service life.

In accordance with the principles of the present invention the foregoing and other objects are attained by a servo valve for an injection nozzle, for example for a common-rail system, including a housing having a valve chamber, a high-pressure opening, a connecting opening and a return opening. A valve member is movable in the valve chamber and, by an actuating means, can be caused to co-operate selectively with a first seat and a second seat. When co-operating with the first seat the valve member closes the return opening and connects the high-pressure to the connecting opening while when co-operating with the second seat the valve member closes the high-pressure opening and connects the connecting opening to the return opening. The connecting opening is adapted to be connected to a working chamber of the injection nozzle which is closable when the working chamber is put under high pressure and openable upon a drop in pressure in the working chamber. The actuating means includes a component which is variable in length when it is acted upon by electric voltage or electric current. The variable-length component is connected to the valve member through the return opening, by way of an actuating member.

As will be seen in greater detail from the following description of a preferred embodiment of the invention the servo valve according to the invention is compact and is extremely simple and thus inexpensive to produce, more especially because it does not require doubly interfitting components. The valve member which is actuated from the actuating member directly through the return opening can be opened directly against a high pressure obtaining in the valve chamber, by means of the electrically actuable variable-length component. Stroke movements of the order of magnitude of between 20 and 30 $\mu$m are sufficient to switch over the servo valve, and for that reason piezoelectric actuators or magnetostrictive actuators can advantageously be employed. The use of a piezoelectric actuator, with the small stroke movements that such an actuator involves, makes it possible to achieve extremely rapid switching times and precise actuating movements of the servo valve. Furthermore, the pattern of the speed of the stroke movement of the valve member can be controlled by suitable actuation of the variable-length component or actuator so that the valve member can come to bear against the seat in a gentle fashion, which is advantageous in terms of achieving a long service life for the servo valve. The variable-length component is advantageously arranged in such a way that the injection nozzle is closed in the voltage-less or current-less condition, and that is advantageous in regard to system reliability and safety. Extremely high system pressures can be used with the valve according to the invention. The high-pressure line is connected directly to the valve chamber so that there is no need for piston guides or the like to provide for sealing integrity in relation to high pressure.

Further objects, features and advantages of the present invention will be apparent from the following description of a preferred embodiment thereof.

BRIEF DESCRIPTION OF THE DRAWING

FIG. 3 is a view in section through a servo valve according to the invention with integrated injection nozzle, FIG. 4 is a view on an enlarged scale of a part of FIG. 3, and FIG. 5 is a view on an enlarged scale of a part of FIG. 4.

DESCRIPTION OF THE PREFERRED EMBODIMENT

It will be noted here that the term common rail is used generally to denote systems whose aim on the one hand is to make the injection pressure of the system independent of the engine speed and the amount of fuel injected and on the other hand to increase the mean injection pressure. A major feature of a common-rail system therefore lies in decoupling of the generation of pressure and fuel injection by means of a storage volume which is composed of the volume of a common high-pressure distributor line (the common rail) connected to the injection nozzles of a multi-cylinder engine, together with the feedlines to the injection nozzles and the volumes available in the nozzles themselves.

Figure 1:
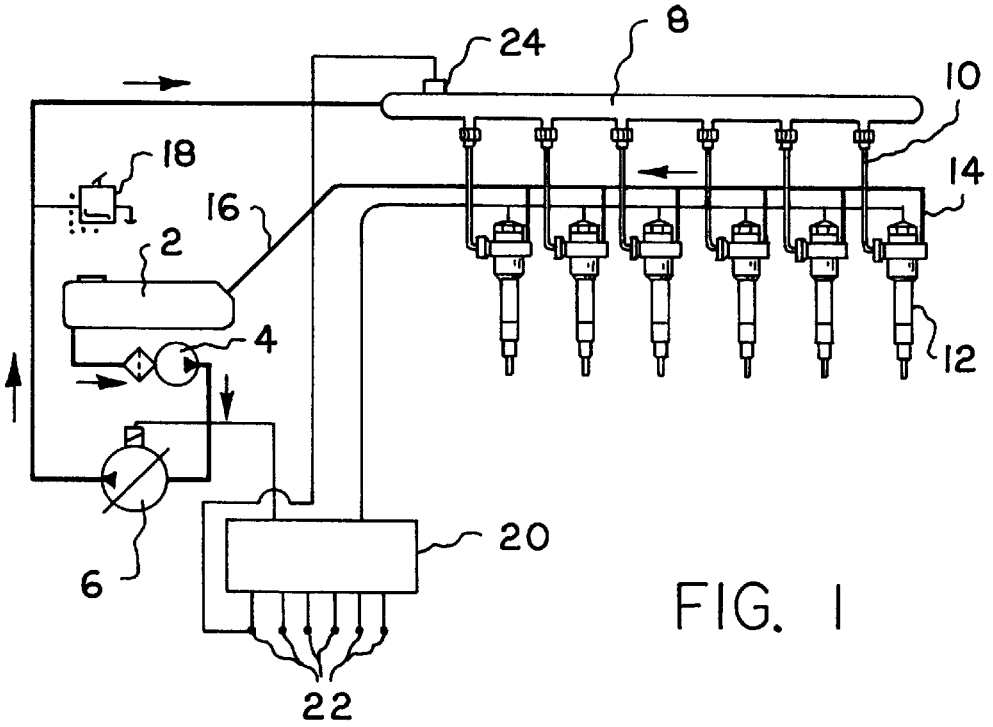
FIG. 1 is an overall diagrammatic view of a common-rail system.

Referring now firstly to FIG. 1, reference numeral 2 denotes a fuel tank which is connected by way of a filter (not shown) and a pre-delivery pump 4 to a common-rail high-pressure pump 6. From the high-pressure pump 6, a line goes to a distributor line, referred to as the common rail 8, which is communicated by way of feed lines 10 with respective injection nozzle units 12 associated with each cylinder of a multi-cylinder internal combustion engine.

The injection nozzle units 12 are communicated by way of return lines 14 with a return line 16 which leads to the tank 2.

The system pressure is limited by means of a restrictor valve 18 and can be up to 2000 bars.

An electronic control device 20 is connected by means of its outputs to the high-pressure pump 6 and to the injection nozzle units 12. The inputs 22 of the control device are connected to a pressure sensor 24 in the common rail 8 and further sensors (not shown), for example for sensing the position of a control pedal such as the accelerator pedal, the speed of travel, temperatures, charge pressure, air mass, engine speed and the like.

Figure 2:
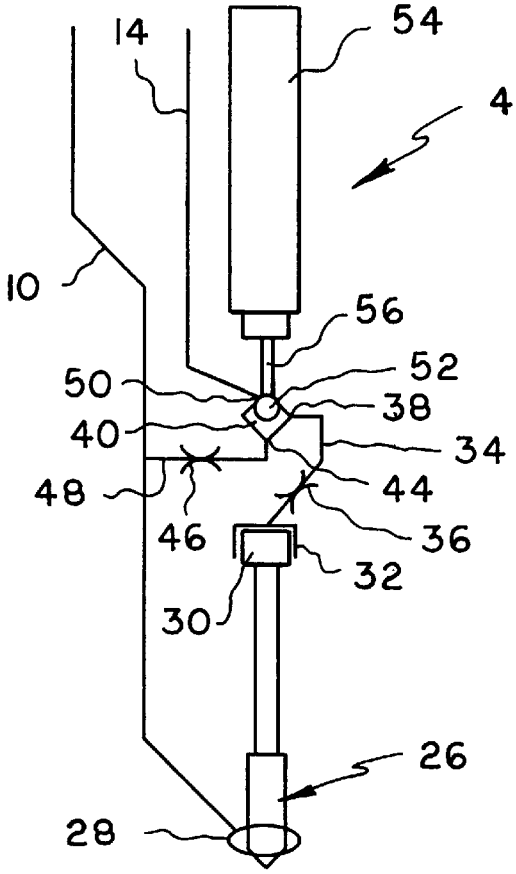
FIG. 2 shows the hydraulic circuit diagram of a servo valve according to the invention.

Reference is now made to FIG. 2 showing the structure in principle of an injection nozzle unit with the associated hydraulic circuit.

The injection nozzle unit 12 includes a nozzle body 26 terminating in a nozzle needle which, in the closed condition of the injection nozzle, bears against a valve seat (not referenced). The nozzle body 26 passes through a nozzle chamber 28 which is communicated with the feed line 10. The nozzle body 26 is connected to or formed integrally with an actuator piston or plunger 30 which operates in a working chamber 32. The working chamber 32 is connected by way of a connecting line 34 with a connecting throttle 36 to a connecting opening 38 which is provided at a valve chamber 40 of a servo valve which is generally identified by reference numeral 42.

The valve chamber 40 further has a high-pressure opening 44 which is connected to the feed line 10 by way of a high-pressure line 48 provided with a feed flow throttle 46.

The valve chamber 40 additionally has a return opening 50 connected to the return line 14. For actuation of a valve member which in this embodiment is in the form of a ball 52, a shank portion 56 which is actuated by an actuating means which in this embodiment is in the form of a piezoelectric actuator 54, projects through the return opening 50. The piezoelectric actuator 54 is connected to the control device indicated at 20 in FIG. 1 by way of suitable electrical connections (not shown).

Piezoelectric actuators are known per se and are of a similar structure to capacitors whose dielectric comprises piezoelectric material, for example lead-zirconate-titanate ceramic. Modern actuators operate with field strengths of up to 2000 V/mm and achieve relative variations in length of up to 1.5%. In the illustrated embodiment, with the piezoelectric actuator 40 being about 30 mm in length therefore, it is thus possible to produce a stroke movement of about 0.03 mm. A typical switching time is 50 $\mu$s, while the speed of movement of the shank portion 56 is controllable by suitable actuation of the piezoelectric actuator 54.

Reference is now made to FIG. 3 showing an overall view in section of an injection nozzle unit 12 with housing 58 and high-pressure connection 60 for connection to the distributor line or common rail indicated at 8 in FIG. 1. FIG. 3 does not show electrical connections, by means of which the piezoelectric actuator 54 is connected to the control device indicated at 20 in FIG. 1.

As the entire injection nozzle unit 12 is mounted directly on the cylinder head of an internal combustion engine, it is advantageous in terms of the precision of valve actuation to compensate for differences in thermally induced lengthwise expansion as between the piezoelectric actuator 54 and the housing 58 which accommodates the piezoelectric actuator 54. That is effected for example by the housing 58, at least in the region of the piezoelectric actuator 54, comprising a suitably selected material having a similarly low level of thermal expansion like that of the piezoelectric actuator 54, for example Invar steel. In another alternative configuration in which the housing 58 comprises normal steel, thermal expansion of the piezoelectric actuator 54 can be compensated for by means of an additional component; thus, as illustrated in FIG. 3, an insert bolt or stud 64 which is secured to the housing 58 by a screw means 62 illustrated in the form of a nut can comprise a material which affords a greater degree of thermal expansion than that of the material of the housing 58, for example aluminium. By suitable matching of the length of the bolt or stud 64 with respect to the length of the piezoelectric actuator 54 and the material of the housing 58 and the length thereof, it is possible to compensate for the low level of thermal expansion of the piezoelectric actuator 54.

Referring now to FIG. 4, shown therein on an enlarged scale is the central region of the injection nozzle unit 12 illustrated in FIG. 3. FIG. 5 in turn shows the central region of the FIG. 4 structure on a further enlarged scale.

As can be seen from FIG. 4, a housing portion 65 which accommodates the injection valve with the actuator plunger or piston 30 and the servo valve is screwed to the housing 58. The valve ball 52 of the servo valve is advantageously urged upwardly by a spring 66 so as to bear against a pin 68 actuated by the piezoelectric actuator 54 or against a first seat indicated at 70 in FIG. 5. The pin 68 co-operates with a component 72 guided in a bore 76 in the housing 58, the piezoelectric actuator 54 also being accommodated in the bore 76. The component 72 is supported by way of a hemispherical portion 74 against the piezoelectric actuator 54. A seal 78 is provided to afford sealing integrity between the component 72 and the inside wall surface of the bore 76. The components 68, 72 and 74 form the shank portion indicated at 56 in FIG. 2.

For sensing the travel of the actuator piston or plunger 30, the arrangement has a needle-type stroke sensor 80 with which the degree of opening of the injection valve (not shown in FIG. 4) can be accurately determined.

FIG. 5 shows the central portion of the servo valve having first and second housing body portions 82 and 84 which are braced against each other between the housing 58 and the housing portion indicated at 65 in FIG. 4, which is screwed to the housing 58.

The housing body portions 82 and 84 have mutually aligned bores forming a part of the feed line 10 which is subjected to high pressure. The housing body portion 82 is further provided with a through bore 86 with which a blind bore 88 in the housing body portion 84 is aligned. A bore representing the high-pressure line 48 leads from the blind bore 88 to the feed line 10.

The sides of the bores 86 and 88, which open at the separating surfaces between the housing body portions 82 and 84, are machined in such a way that they receive with an oversize the ball 52 forming the valve member, and, as shown in FIG. 5, form a first seat 70 at the top and a second seat 90 at the bottom. Between the seats 70 and 90, the connecting opening indicated at 38 in FIG. 2 leads from the valve chamber indicated at 40 in FIG. 2, which accommodates the ball 52, to the connecting line 34 in which the connecting throttle 36 is arranged. FIG. 5 does not show the feed flow throttle indicated at 46 in FIG. 2, in the high-pressure line 48.

At its upper part the through bore 86 terminates in an annular recess 90 from which extends the return line which is indicated at 14 in FIG. 2 but which is not shown in FIGS. 4 and 5. At its outside, the pin 68 shown in FIG. 4 advantageously has longitudinal grooves so that it does not completely close off the through bore 86.

The structure of the servo valve according to the invention in an injection nozzle having been described, the mode of operation thereof will now be set forth:

In the non-powered condition of the piezoelectric actuator 54, the ball 52 co-operates with and thus bears against the first seat 70 which is thus the upper seat in FIG. 5. The return line 14 is thus closed and the high-pressure line 48 is connected to the connecting line 34 so that the working chamber 32 is acted upon by high pressure, when system pressure obtains. The injection nozzle is then closed as the force acting on the nozzle body indicated at 26 in FIG. 2 from the working chamber 32 is greater than the force acting from the nozzle chamber 28.

When the piezoelectric actuator 54 is excited, the ball 52 is lifted off the first seat 70 against the high system pressure and moves into a position of co-operating with and thus bearing against the second seat indicated at 90 in FIG. 5, whereby the high-pressure line 48 is separated from the valve chamber 40 and the connecting line 34 is connected to the return line 14. Fluid flows away out of the working chamber 32. The effect of the pressure drop is that the nozzle body moves upwardly and thus opens the nozzle, under the influence of the high pressure which is acting from the nozzle chamber 28.

The dynamics of the system are extremely precise by virtue of the extremely small valve stroke movement involved and the rapid response characteristics on the part of the piezoelectric actuator, and can be varied by suitable choice of the nozzles 46 and/or 36. The period of time during which the two seats 70 and 90 are open and the high-pressure line 48 is connected to the return line 14 is extremely short so that losses are reduced to a minimum.

It will be appreciated that the above-described servo valve for an injection nozzle in accordance with the invention has been set forth solely by way of example and illustration of the principles of the invention and that various modifications and alterations may be made therein without thereby departing from the spirit and scope of the invention.

What is claimed is:

1. A servo valve for an injection nozzle, including:

a housing (82, 84) having a valve chamber (40), a high-pressure opening (44), a connecting opening (38), and a return opening (50);

a first seat (70) and a second seat (90);

a valve member (52) movable in the valve chamber (40); and an actuating means (54, 56) adapted to move the valve member (52) selectively between a first position of bearing against the first seat (70) and a second position of bearing against the second seat (90), the actuating means including a piezoelectric actuator (54) and an actuating member (56) passing through said return opening (50) and operatively connecting said piezoelectric actuator (54) to said valve member (52), wherein in said first position the valve member (52) closes the return opening (50) and connects the high-pressure opening (44) to the connecting opening (38) and in said second position the valve member (52) closes the high-pressure opening (44) and connects the connecting opening (38) to the return opening (50) and wherein the connecting opening (38) is adapted to be connected to a working chamber (32) of the injection nozzle which is closable when the working chamber (32) is put under high pressure and openable upon a drop in pressure in the working chamber (32).

2. A servo valve as set forth in claim 1 wherein the valve member (52) is in the form of a ball.

3. A servo valve as set forth in claim 1 wherein said valve member (52) is in said first position when the piezoelectric actuator (54) is without voltage.

4. A servo valve as set forth in claim 1 including a high-pressure line (48) leading to the high-pressure opening (44) and a feed flow throttle means (46) in said high-pressure line.

5. A servo valve as set forth in claim 1 including a connecting line (34) leading from the connecting opening (38) to the working chamber (32), and a throttle means (36) in said connecting line.

6. A servo valve as set forth in claim 1 and including an additional component (64) for compensating for thermal expansion of said piezoelectric actuator (54).

7. A servo valve as set forth in claim 1 and including a housing means (58) accommodating the piezoelectric actuator (54), wherein said housing means (58) comprises a material selected to provide for compensation for thermal expansion of said piezoelectric actuator (54).

* * * * *